US011383891B2

(12) United States Patent
Plourde et al.

(10) Patent No.: US 11,383,891 B2
(45) Date of Patent: Jul. 12, 2022

(54) CHILD-DETERRENT PACKAGING HAVING A BARRIER TO PROTECT CONTENTS FROM SURROUNDING ENVIRONMENT

(71) Applicant: Illinois Tool Works Inc., Glenview, IL (US)

(72) Inventors: Eric Plourde, Frankfort, IL (US); Lars G Wihlborg, Carol Stream, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 17/162,696

(22) Filed: Jan. 29, 2021

(65) Prior Publication Data

US 2021/0237938 A1 Aug. 5, 2021

Related U.S. Application Data

(60) Provisional application No. 62/968,719, filed on Jan. 31, 2020.

(51) Int. Cl.
*B65D 33/25* (2006.01)
*B65D 33/18* (2006.01)

(52) U.S. Cl.
CPC ..... *B65D 33/2566* (2013.01); *B65D 33/18* (2013.01)

(58) Field of Classification Search
CPC . B65D 33/2566; B65D 33/18; B65D 33/2575
USPC ..... 383/35, 65, 210–211
See application file for complete search history.

(56) References Cited

U.S. PATENT DOCUMENTS

| | | | | |
|---|---|---|---|---|
| 4,969,967 | A | 11/1990 | Sorensen | |
| 5,188,461 | A | 2/1993 | Sorensen | |
| 5,238,306 | A | 8/1993 | Heintz | |
| 5,470,156 | A * | 11/1995 | May | B65D 33/18 383/210 |
| 5,489,252 | A | 2/1996 | May | |
| 5,509,735 | A | 4/1996 | May | |
| 5,551,127 | A | 9/1996 | May | |
| 5,647,671 | A | 7/1997 | May | |
| 5,725,312 | A | 3/1998 | May | |
| 5,774,954 | A | 7/1998 | Ramsey | |
| 5,832,570 | A | 11/1998 | Thorpe | |

(Continued)

FOREIGN PATENT DOCUMENTS

| | | | | |
|---|---|---|---|---|
| WO | WO-2020006354 A1 * | 1/2020 | ..... | B65D 33/2541 |
| WO | WO-2020062467 A1 * | 4/2020 | ..... | B65D 33/2566 |

*Primary Examiner* — Jes F Pascua
(74) *Attorney, Agent, or Firm* — Christopher R. Carroll; The Small Patent Law Group LLC

(57) ABSTRACT

Child-deterrent packaging includes an enclosure having opposing first and second sidewalls coupled with each other. The child-deterrent packaging also includes a zipper assembly coupled with the first and second sidewalls of the enclosure. The zipper assembly includes first and second zipper portions that mate with each other to enclose product that release from each other to provide access to the product. The child-deterrent packaging also includes a peel seal providing a barrier to ingress of one or more of oxygen or moisture. The peel seal is one or more of: disposed between and coupling the first and second zipper portions with each other, disposed between and coupling an entry section of the first sidewall with the first zipper portion of the zipper assembly, or disposed between and coupling the entry section of the first sidewall with another portion of the first sidewall.

21 Claims, 5 Drawing Sheets

(56) References Cited

U.S. PATENT DOCUMENTS

| | | | | |
|---|---|---|---|---|
| 5,887,980 | A | 3/1999 | May | |
| 5,893,645 | A | 4/1999 | May | |
| 5,904,425 | A | 5/1999 | May | |
| 5,930,877 | A | 8/1999 | Thorpe | |
| 6,079,878 | A | 6/2000 | Yeager | |
| 6,131,248 | A | 10/2000 | Tomic | |
| 6,183,134 | B1 | 2/2001 | Malin | |
| 6,290,393 | B1 | 9/2001 | Tomic | |
| 6,317,939 | B1 | 11/2001 | Malin | |
| 6,327,837 | B1 | 12/2001 | Van Erden | |
| 6,595,690 | B2 | 7/2003 | Machacek | |
| 6,715,262 | B2 | 4/2004 | Malin | |
| 6,863,646 | B2 | 3/2005 | Kinigakis | |
| 7,094,455 | B2 | 8/2006 | Johnson | |
| 7,207,718 | B2 | 4/2007 | Machacek | |
| 7,213,305 | B2 | 5/2007 | Stolmeier | |
| 8,011,831 | B2 | 9/2011 | Tanaka | |
| 8,087,828 | B2 | 1/2012 | Noguchi | |
| 8,105,225 | B2 | 1/2012 | Ausnit | |
| 8,484,934 | B2 | 7/2013 | Anzini | |
| 9,254,620 | B2 | 2/2016 | Anzini | |
| 10,011,403 | B1 * | 7/2018 | Kirsh | B65D 50/00 |
| 10,011,404 | B1 * | 7/2018 | Kirsh | B65D 33/007 |
| 10,507,959 | B2 * | 12/2019 | Kirsh | B65D 33/007 |
| 2004/0188310 | A1 * | 9/2004 | Hamilton | B65D 33/2508 206/524.8 |
| 2014/0270586 | A1 * | 9/2014 | Petkovsek | B65D 33/2508 383/63 |
| 2017/0217650 | A1 * | 8/2017 | Steele | B65D 33/2591 |

* cited by examiner

CHILD-DETERRENT PACKAGING HAVING A BARRIER TO PROTECT CONTENTS FROM SURROUNDING ENVIRONMENT

CROSS-REFERENCE TO RELATED APPLICATION

The present application claims the benefit of U.S. Provisional Application No. 62/968,719, which was filed on 31 Jan. 2020 and is incorporated herein by reference in its entirety.

FIELD

The subject matter of the present application relates to packaging and enclosures that are configured to impede or prevent children from opening.

BACKGROUND

A variety of products exist for containing, storing, and/or transporting substances. Flexible enclosures, such as resealable bags, can be used to hold a wide variety of contents. Flexible enclosures have become more popular because such enclosures can be readily opened but also sealed to provide sufficient protection of the contents therein. For food items, such as grain, chips, nuts, and the like, flexible enclosures can uphold the freshness of the food longer than user-improvised methods.

For content that may pose a risk to children, such as cleaning products, prescribed medications, or recreational substances (e.g., cannabis products), it is desirable for the flexible enclosure to impede a child from opening the enclosure. It is also desirable for this content to maintain its efficacy and/or increase its shelf-life. These two characteristics are often associated with how well the content is sealed by the flexible enclosure. Flexible enclosures used today may not be suitable for protecting content from exposure to unwanted material while also being capable of impeding a child from opening the flexible enclosure.

BRIEF DESCRIPTION

In one or more embodiments, a child-deterrent packaging is provided that includes an enclosure having opposing first and second sidewalls coupled with each other. The first sidewall has an entry section extending away from the first and second sidewalls. The child-deterrent packaging also includes a zipper assembly coupled with the first and second sidewalls of the enclosure. The zipper assembly is also disposed between the second sidewall and the entry section of the first sidewall. The zipper assembly includes first and second zipper portions that mate with each other to enclose product within the enclosure and that release from each other to provide access to the product within the enclosure. The child-deterrent packaging also includes a peel seal providing a barrier to ingress of one or more of oxygen or moisture into the enclosure through the zipper assembly. The peel seal is one or more of: disposed between and coupling the first and second zipper portions with each other, disposed between and coupling the entry section of the first sidewall with the first zipper portion of the zipper assembly, or disposed between and coupling the entry section of the first sidewall with another portion of the first sidewall.

Optionally, each of the first zipper portion and the second zipper portion includes zipper extensions extending within the enclosure. The peel seal is disposed between and coupled with surfaces of the zipper extensions of the first zipper portion and the second zipper portion that face each other.

Optionally, the first zipper portion is affixed to the first sidewall and the second zipper portion is affixed to the second sidewall. The peel seal couples an interior surface of the entry section with an exterior surface of the first zipper portion that faces away from the second zipper portion.

Optionally, the entry section has a length that extends over an overlapped portion of the first sidewall such that the overlapped portion of the first sidewall is located between the entry section and the first zipper portion.

Optionally, the peel seal couples an interior surface of the entry section with an exterior surface of the overlapped portion of the first sidewall.

Optionally, the peel seal is formed from a resealable adhesive that is applied to one or more of the entry section, the zipper assembly, or the first sidewall at a location other than the entry section.

Optionally, the peel seal is a single-use seal that is ruptured after separating the entry section from one or more of the first zipper portion or the first sidewall.

Optionally, the peel seal is a multiple-use seal that can be opened and re-sealed two or more times after separating the entry section from one or more of the first zipper portion or the first sidewall.

Optionally, the entry section is formed by a slit in the first sidewall with the first zipper portion affixed to the first sidewall in locations on opposite sides of the slit.

In one or more embodiments, a resealable assembly for joining opposing first and second sidewalls of an enclosure is provided. The first sidewall has a slit and forms an entry section. The resealable assembly includes a first zipper portion configured to be affixed to the first sidewall and a second zipper portion configured to be affixed to the second sidewall. The first and second zipper portions are shaped to mate and unmate with each other to enclose and provide access to, respectively, an interior cavity of the enclosure. The resealable assembly also includes a peel seal one or more of: coupling the entry section of the first sidewall with the first zipper portion, coupling the entry section of the first sidewall with another portion of the first sidewall, or coupling the first zipper portion with the second zipper portion.

Optionally, the peel seal forms a barrier to ingress of one or more of oxygen or moisture into the interior of the enclosure through the zipper assembly.

Optionally, the peel seal couples an interior surface of the entry section of the first sidewall with an exterior surface of the first zipper portion.

Optionally, the entry section of the first sidewall has a length that extends over an overlapped portion of the first sidewall that is affixed to the first zipper portion such that the overlapped portion of the first sidewall is located between the entry section of the first sidewall and the first zipper portion.

Optionally, the peel seal couples an interior surface of the entry section of the first sidewall with an exterior surface of the overlapped portion of the first sidewall.

Optionally, the peel seal is formed from a resealable adhesive applied to one or more of the entry section of the first sidewall, the first zipper portion, or a location on the first sidewall other than the entry section.

Optionally, the peel seal is a single-use seal that is broken after separating the entry section of the first sidewall from one or more of the first zipper portion or the first sidewall.

Optionally, the peel seal is a multiple-use seal that can be opened and re-sealed two or more times after separating the entry section of the first sidewall from one or more of the first zipper portion or the first sidewall.

In one or more embodiments, an enclosure is provided that includes first and second sidewalls coupled with each other. The first sidewall has an entry section extending away from the first sidewall to an outer edge. The enclosure also includes a zipper assembly coupled with the first and second sidewalls and disposed between the second sidewall and the entry section of the first sidewall. The zipper assembly is configured to enclose an interior cavity between the first and second sidewalls and open to provide access to the interior volume. The enclosure also includes a peel seal one or more of: disposed between and coupling the entry section of the first sidewall with the zipper assembly, disposed between and coupling the entry section of the first sidewall with another portion of the first sidewall, or disposed between and coupling opposing surfaces of the zipper assembly with each other.

Optionally, the peel seal provides a barrier to ingress of one or more of oxygen or moisture into the interior volume through the zipper assembly.

Optionally, the peel seal couples an interior side of the entry section of the first sidewall with an exterior side of the zipper assembly.

Optionally, the peel seal couples an interior side of the entry section of the first sidewall with an exterior side of the first sidewall.

Optionally, the peel seal is located outside of an interior cavity.

One or more embodiments may include more than one peel seal. For example, a first peel seal may be disposed between opposing surfaces of the zipper assembly and couple the opposing surfaces of the zipper assembly with each other. A second peel seal may be disposed between and couple the entry section of the first sidewall with the zipper assembly. A third peel seal may be disposed between and couple the entry section of the first sidewall with another portion of the first sidewall. Alternatively, one or more embodiments may include the first and second peel seals, but not the third peel seal. Alternatively, one or more embodiments may include the first and third peel seals, but not the second peel seal. Alternatively, one or more embodiments may include the second and third peel seals, but not the first peel seal.

One or more embodiments may include an overlapping peel seal disposed between the entry section and both the zipper assembly and another portion of the first sidewall. In particular, the peel seal may extend between and couple the entry section of the first sidewall to the zipper assembly and also another portion of the first sidewall. The peel seal may be sized and shaped to couple to the portion of the first sidewall and also clear an edge of the portion of the first sidewall and couple to the zipper assembly.

BRIEF DESCRIPTION OF THE DRAWINGS

The inventive subject matter will now be illustrated with reference to the following figures, in which.

DETAILED DESCRIPTION

Figure 1:
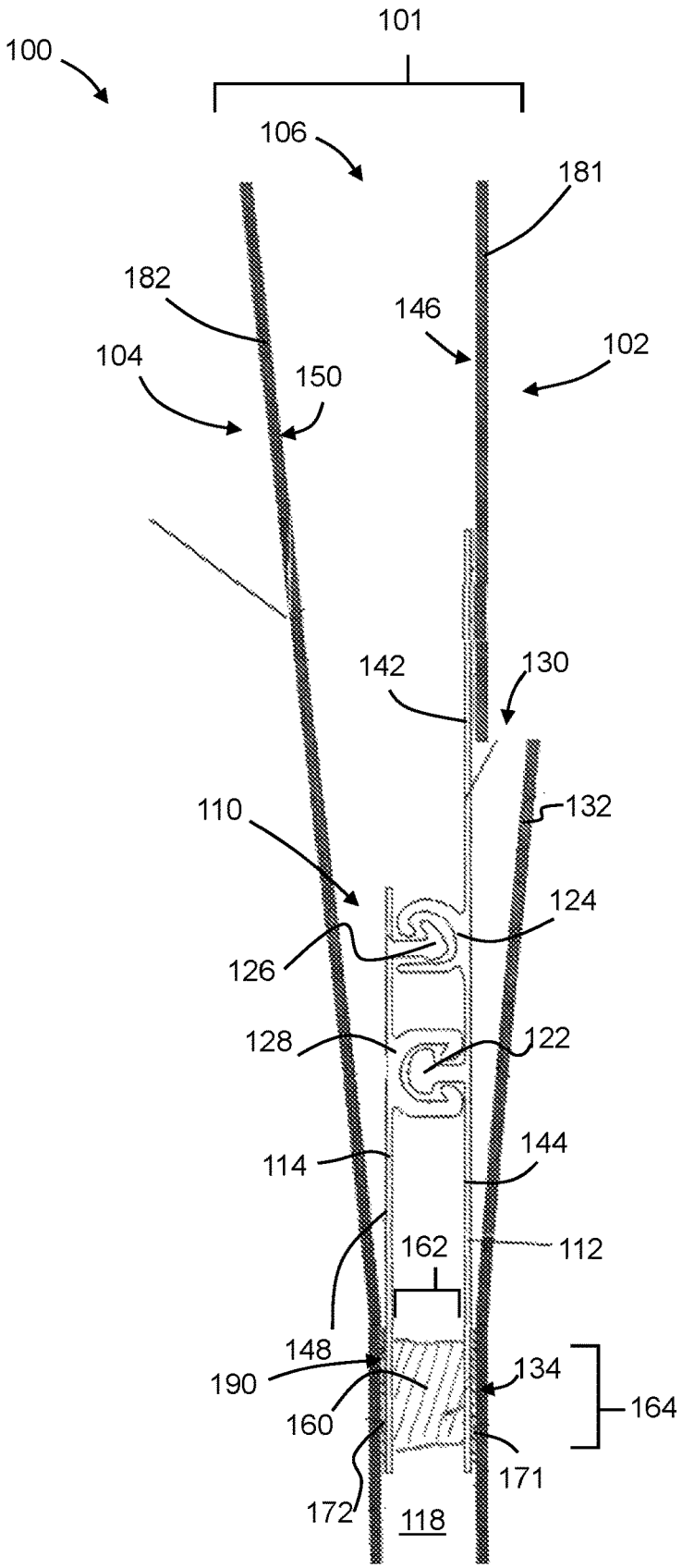
FIG. 1 is a cross section of child-deterrent packaging formed in accordance with an embodiment that includes a flexible enclosure and a resealer.

One or more embodiments set forth herein can include child-deterrent packaging having a flexible enclosure and a resealable assembly (or resealer). The child-deterrent packaging may include a barrier to ingress of one or more of oxygen or moisture into the cavity where the contents are stored. One or more embodiments may be particularly suitable for holding content that can be damaged or affected by exposure to gases or moisture but that also poses a risk to children or other vulnerable and unknowing individuals. Non-limiting examples of such content includes cleaning products, prescribed medications, or recreational sub stances (e.g., cannabis products).

The flexible enclosure defines a cavity where the content is stored. In certain embodiments, the flexible enclosure may be configured to be initially opened by separating the resealable assembly, thereby forming an access opening into the cavity. Content may be passable through the access opening.

In particular embodiments, the resealable assembly includes the barrier. In other embodiments, the barrier is separate from the resealable assembly. The resealable assembly permits a person to open the packaging to have access to the content and also close the packaging so that the content is held therein. The resealable assembly typically includes two features that oppose each other with an opening therebetween for accessing the content. These two features may be referred to as a resealer, although the resealable assembly may include additional features that do not assist in sealing the packaging. In the illustrated embodiment described below, the resealable assembly includes a zipper assembly having opposed first and second zipper portions.

Other embodiments, however, may include one or more other types of resealers. For example, the resealer may include at least one of an intermeshable closure member, parallel fastener strips, cooperating adhesive strips, hook-and-loop fastener elements, or a slider or a combination thereof. The resealer may include, for example, a track and a strip on opposing surfaces of the enclosure in which the strip fits within and along the track. Optionally, the resealer may include two tracks and two strips in which each track receives one strip. As another example, the resealer may include two opposing hook-filled lanes or strips. When brought together, the hooks of one lane couple to the hooks of the opposing lane, thereby sealing the enclosure. The hooks could be configured to engage on multiple levels. Optionally, the width of the lanes may be configured so that precise alignment is not required. The hooks may provide an audible and tactile response when the lanes are brought together for closing.

The barrier comprises a material that blocks or impedes the ingress of unwanted gases or liquids into the cavity where the content can be exposed to the unwanted gases or liquid. Depending on the type of molecular interactions, the barrier may be characterized as a passive barrier or an active barrier. A barrier may include both passive and active materials. In some embodiments, the barrier may include at least one of a multi-layered stack, a coating, or a composite material. A multi-layered stack may include two or more layers. Non-limiting examples of material that may be used for a layer of the multi-layered stack include polystyrene, polyethylene, polypropylene, poly(lactic acid), poly(vinyl chloride), polyamide-6, poly(ethylene naphthalate), poly (ethylene terephthalate), poly(m-xylylene adipamide), poly (vinyl alcohol), ethylene vinyl alcohol, and poly(vinylidene chloride). Coatings may be applied directly to the surface of the flexible enclosure. Non-limiting examples of a coating include epoxy-amine, diamond-like carbon (DLC), and silicon oxide (SiOx). Coatings and multi-layered stacks can also be combined. An example of a composite includes nylon poly(m-xylene adipamide) (MXD6) that is added to (e.g., blended) with poly(ethylene terephthalate). In particular embodiments, the barrier is configured to block or impede the ingress of oxygen whether by passive or active interactions.

In particular embodiments, the barrier is provided by a peel seal. The peel seal may comprise a polymeric material, such one or more of the materials described above. For example, the peel seal may comprise at least one of polyethylene (including a polyethylene copolymer), polypropylene, ionomers, amorphous polyester, vinyl acetate, polybutylene, or nylon ethylene-vinyl alcohol copolymer (EVOH).

Optionally, the peel seal may include a one-time frangible seal that can be opened cohesively or adhesively. For example, a one-time opening peel seal material can be provided by blending polybutene with polyethylene. Alternatively, the peel seal may include a material that is capable of being reused to open and close the barrier. For example, the peel seal may include an adhesive seal that attaches to an opposing surface. The peel seal could be provided after the packaging is filled with the content through an opening defined by the resealer. For example, the peel seal may be provided by heated seal bars that press from the outside of the packaging sidewalls. Alternatively, the peel seal could be made prior to the resealer being attached to the package. The peel seal may be added prior to the content being filled through the opening of the resealer (e.g., fill-behind, bottom fill, fill through the wall, and the like).

FIG. 1 illustrates a cross-section of a child-deterrent packaging 100. The packaging 100 includes an enclosure 101 and a resealable assembly 110 that is coupled with the enclosure 101. The enclosure 101 includes a first sidewall 102 and a second sidewall 104. The resealable assembly 110 is positioned between the first and second sidewalls 102, 104. Each of the first and second sidewalls 102, 104 may be coupled to the resealable assembly 110 such that the resealable assembly 110 couples the first and second sidewalls 102, 104 with each other.

Figure 5:
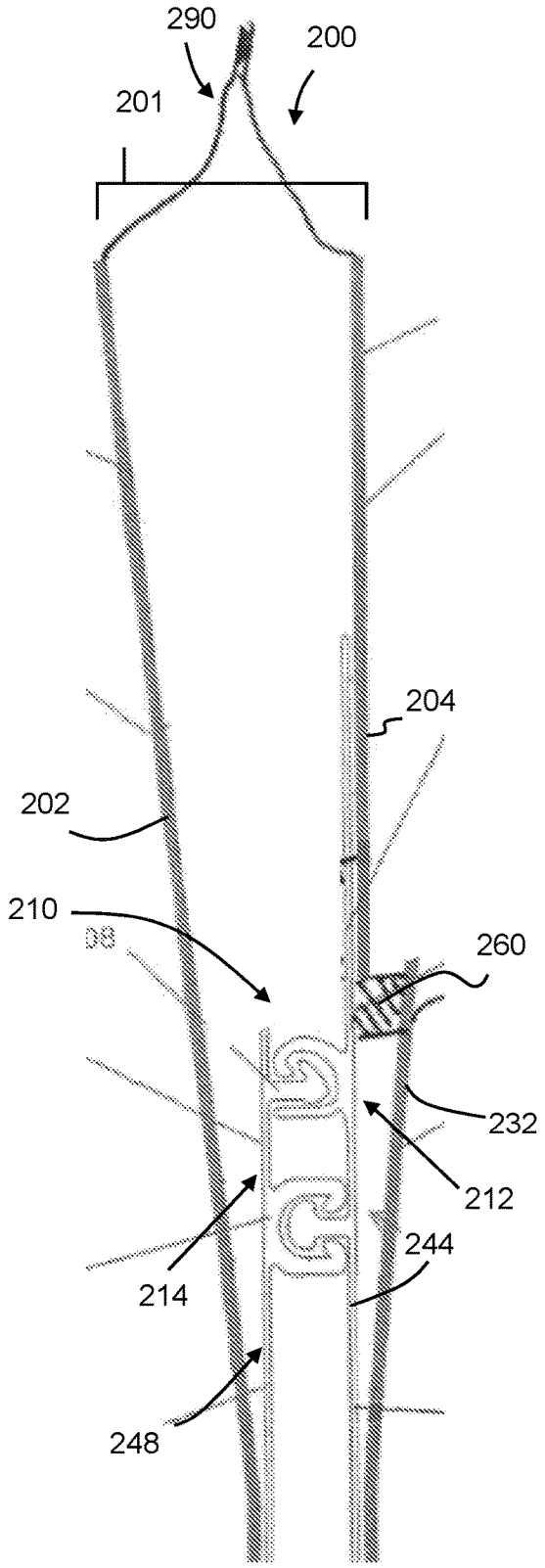
FIG. 5 is a cross section of child-deterrent packaging formed in accordance with an embodiment.
Figure 6:
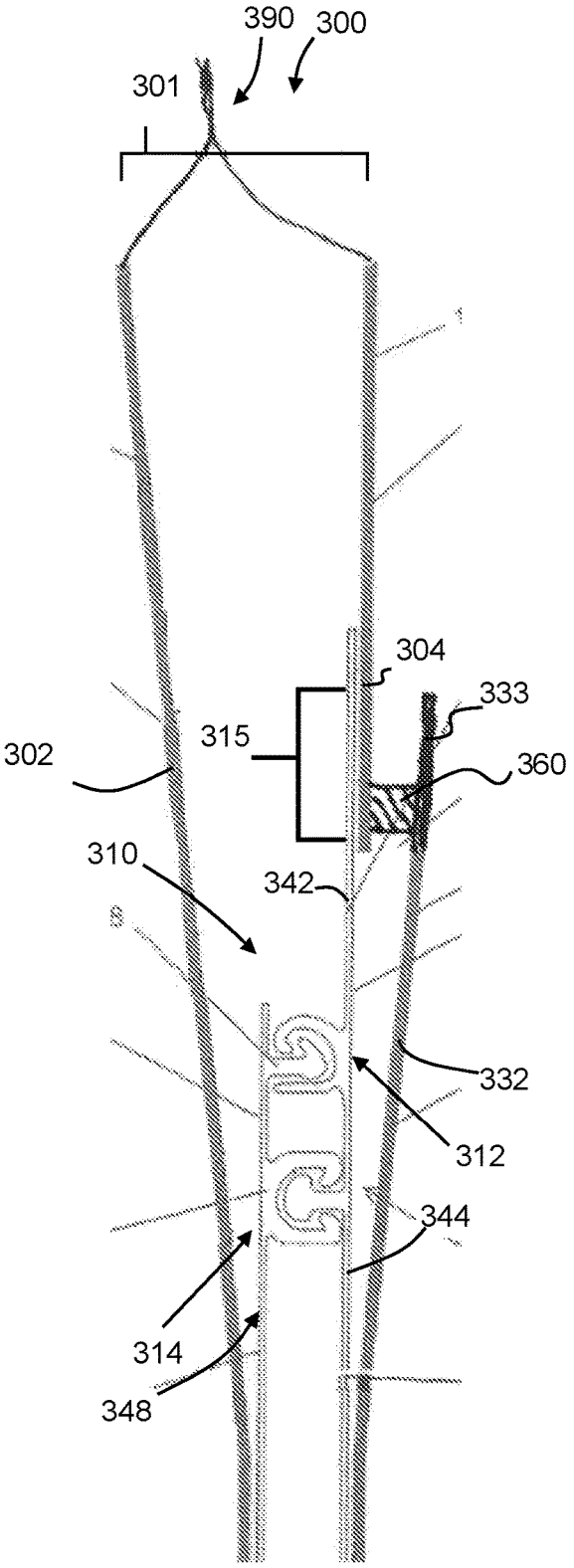
FIG. 6 is a cross section of child-deterrent packaging formed in accordance with an embodiment.

In the illustrated embodiment, the first and second sidewalls 102, 104 define an opening 106 along a top of the enclosure 101. In other embodiments, the first and second sidewalls 102, 104 may be joined side-by-side (e.g., sealed). Examples of such embodiments are illustrated in FIGS. 5 and 6.

As shown in FIG. 1, the zipper assembly 110 includes a first zipper portion or segment 112 and a second zipper portion or segment 114 that are configured to mate with each other to enclose product within an interior cavity 118 of the enclosure 101. The first and second zipper portions 112, 114 unmate or release from each other to provide access to the product within the interior cavity 118. As shown, the first zipper portion 112 is coupled to the first sidewall 102, and the second zipper portion 114 is coupled to the second sidewall 104. In the illustrated embodiment, the first zipper portion 112 has a male interlocking element 122 and a female interlocking element 124. The second zipper portion 114 has a male interlocking element 126 and a female interlocking element 128. When the first and second zipper portions 112, 114 are mated, the female interlocking element 124 of the first zipper portion 112 receives the male interlocking element 126 of the second zipper portion 114. The female interlocking element 128 of the second zipper portion 114 receives the male interlocking element 122 of the first zipper portion 112.

The first zipper portion 112 has an upper zipper extension 142 extending away from the interlocking elements 122, 124 and a lower zipper extension 144 extending away from the interlocking elements 122, 124. Each of the upper and lower zipper extensions 142, 144 are secured to different areas of an interior surface 146 of the first sidewall 102. The second zipper portion 114 has a lower zipper extension 148 extending away from the interlocking elements 126, 128. The lower zipper extension 148 is secured to an interior surface 150 of the second sidewall 104. The lower zipper extensions 144, 148 are each affixed to the interior surfaces 146, 150 of the first and second sidewalls 102, 104, thereby coupling the first and second sidewalls 102, 104.

Figure 2:
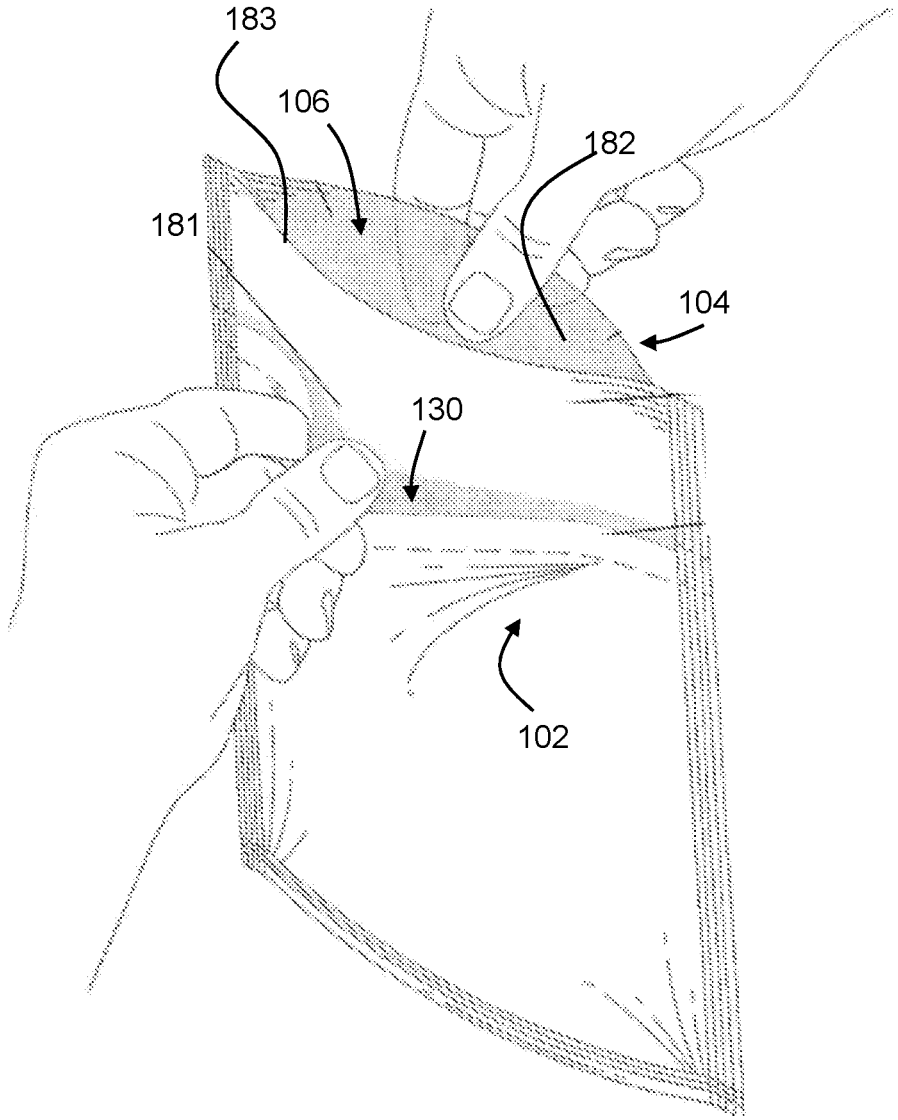
FIG. 2 is a perspective of the child-deterrent packaging of FIG. 1 as an individual manipulates the packaging to open the packaging.

The first sidewall 102 includes a slit 130. The slit 130 may be shaped to define an entry section 132. In some embodiments, the slit 130 extends across only a portion of the width of the first sidewall 102. In other embodiments, the slit 130 extends across the entire width of the first sidewall 102 such that a top portion of the sidewall 102 (identified as first top section 181) and a bottom portion of the first sidewall 102 (identified as the entry section 132) constitute separate sections of the original first sidewall 102. The separate top and entry sections 181, 132 may be secure to the second sidewall 104 through edge heat seals as shown in FIG. 2. The entry section 132 may be secured (e.g., sealed or bonded) to the first zipper portion 112 at a base 134 of the entry section 132. The entry section 132 may be sized and shaped to be gripped by an individual. In some embodiments, the shape and physical attributes of the entry section 132 may permit the entry section 132 to extend away from the remainder of the first sidewall 102 when the force of gravity pulls on the entry section.

In FIG. 1, the zipper assembly 110 is in a closed or sealed state in which the first and second zipper portions 112, 114 are mated with each other. Also shown, the zipper assembly 110 includes a peel seal 160 that extends between and joins the lower zipper extensions 144, 148. In the closed state, the zipper assembly 110 defines a gap 162 that represents a maximum space separating the lower zipper extensions 144, 148. The peel seal 160 may be shaped to have a depth 164. While a larger gap 162 may provide a larger surface area along the peel seal 160 that is exposed to the environment, a smaller gap 162 and a greater depth 164 inhibits ingress of unwanted gases and liquid. A ratio of the depth to the gap may be configured to reduce the likelihood that unwanted gases (e.g., oxygen) and unwanted liquids (e.g., moisture) permeate the peel seal 160. As such, the peel seal 160 may be configured to function as a barrier that protects the product within the interior cavity 118 from exposure.

The packaging 100 may be formed from various materials, including plastic and/or thermoplastic films, such as but not limited to polyethylene, polypropylene, etc. In some embodiments, a single continuous layer may be folded to provide the first and second sidewalls 102, 104. The first and second sidewalls 102, 104 may be coupled with one another (e.g., heat sealed) to define the interior cavity 118 (FIG. 1). For example, the zipper assembly 110 may be affixed to the single continuous layer at one location 171 and, after the single continuous layer is folded, affixed to a second location 172.

Figure 3:
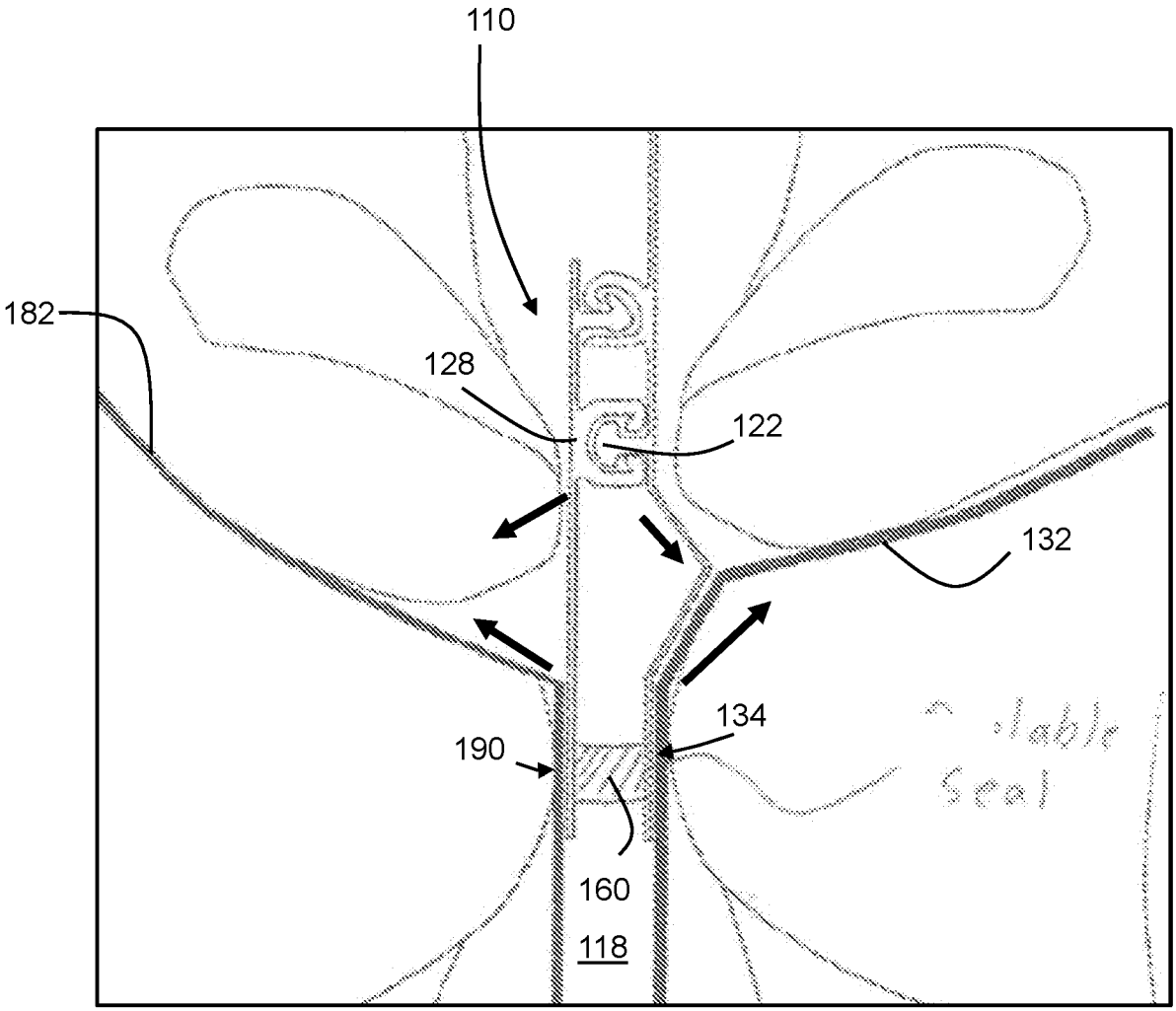
FIG. 3 is a cross-section of the child-deterrent packaging of FIG. 1 as a barrier is ruptured by the individual opening the packaging.
Figure 4:
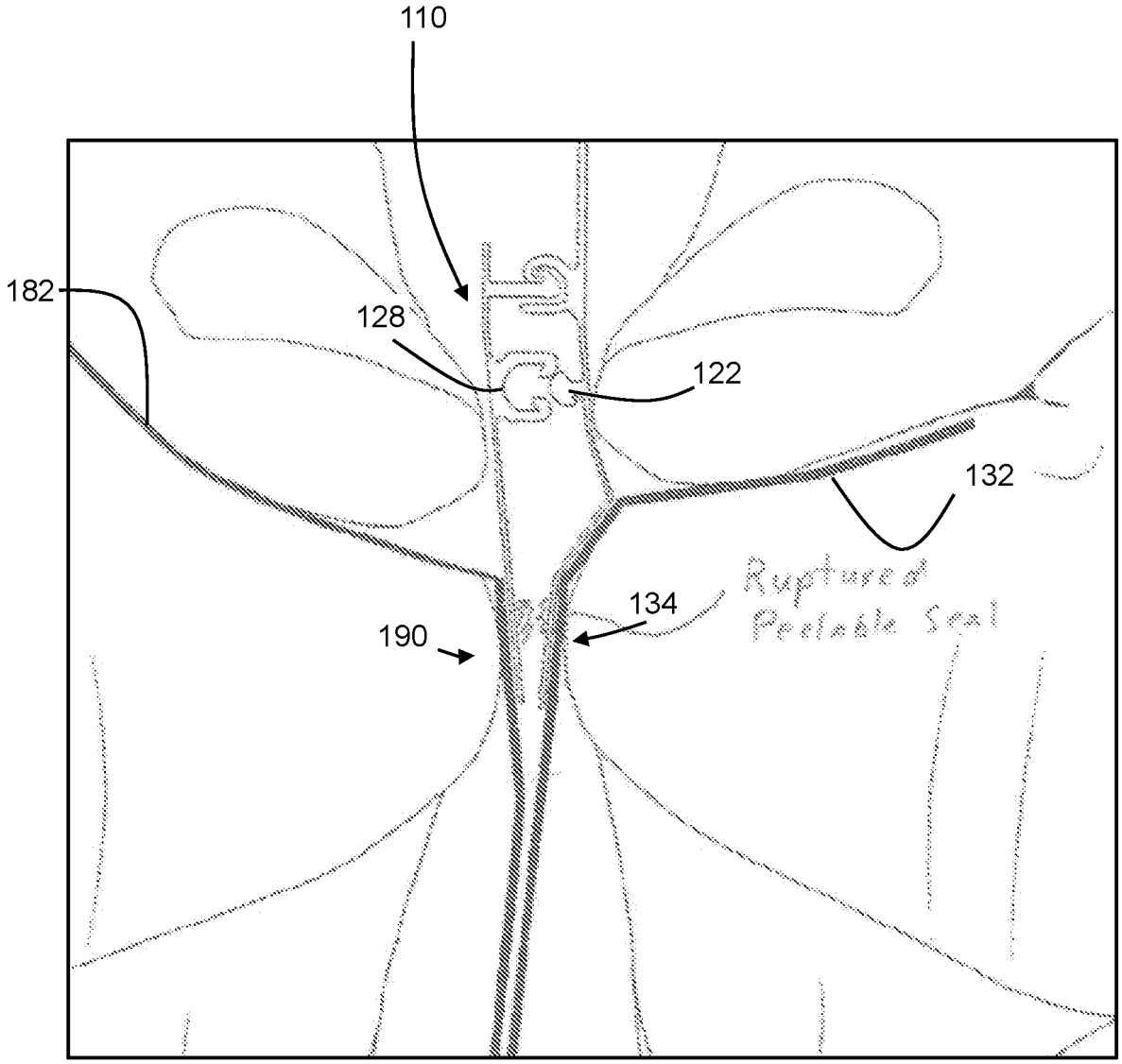
FIG. 4 is a perspective view of a child-deterrent packaging formed in accordance with an embodiment.

FIGS. 2-4 illustrate how the packaging 100 may be opened. When the first and second sidewalls 102, 104 are separated along the top of the packaging such that the opening 106 exists, the first sidewall 102 may form a first top section 181 and the second sidewall 104 may form a second top section 182. The first top section 181 is a portion of the first sidewall 102 that extends from the slit 130 to a top edge 183 of the first sidewall 102.

Returning to FIG. 1, the second top section 182 may be secured to the zipper assembly 110 at a base 190. However, the first top section 181 is not secured to the base 134. Instead, the slit 130 effectively separates the first top section 181 from the entry section 132. As such, pulling on first and second top sections 181 and 182 may not cause the zipper assembly 110 to unmate or release.

With respect to FIGS. 1, 3, and 4, the zipper assembly 110 can only be opened by pulling zipper assembly 110 at points below the interlocking elements 122, 128. In this regard, attempts to pull the zipper assembly 110 apart from above the interlocking elements will be met with greater resistance or difficulty. For example, a child could grab the packaging 100 by the first and second top sections 181, 182 but would not be able to open the packaging 100. Moreover, during this attempt by the child, the peel seal 160 would remain intact and would not rupture to allow unwanted gases or liquids into the interior cavity 118. When the zipper assembly 110 is pulled apart at points below the interlocking elements 122, 128, the separation forces (as illustrated by the arrows) are sufficient for separating the zipper assembly 110 and rupturing the peel seal 160. In some embodiments, the peel seal 160 is damaged when separated. In other embodiments, the peel seal 160 may be separated into designated portions (e.g., layers) and resealed.

Also shown in FIGS. 1, 3, and 4, the peel seal 160 is positioned directly between the bases 134 and 190. In other embodiments, the peel seal 160 may be positioned above the opposite bases 134, 190 or below the opposite bases 134, 190. In such instances, even if a child were to grab the second top section 182 and the entry section 132 and attempt to separate the first and second sidewalls 102, 104 at the bases 134, 190, the peel seal 160 may not experience separation forces and remain intact.

FIGS. 5 and 6 are cross-sections of packaging 200 and packaging 300, respectively, which may have elements and features that are similar or identical to the elements and features of the packaging 100 (FIG. 1). For example, the packaging 200 has an enclosure 201 that includes first and second sidewalls 202, 204 as shown in FIG. 5, and the packaging 300 has an enclosure 301 that includes first and second sidewalls 302, 304 as shown in FIG. 6. The packagings 200 and 300 have respective peel seals 260, 360 and respective zipper assemblies 210, 310. The zipper assemblies 210, 310 may operate in a similar or identical manner as the zipper assembly 110 described above.

For the illustrated embodiments of FIGS. 5 and 6, the packagings 200, 300 are accessed through top edges 290, 390, respectively. The top edges 290, 390 may be formed, for example, by heat-sealing the first and second sidewalls. To open the top edges, the first and second sidewalls may be pulled apart, torn open using, for example, score lines, or cut open. Once opened, a user may grip respective entry sections 232, 332 after separating the entry sections 232, 332 from the peel seals 260, 360 or by rupturing the peel seals 260, 360. The entry sections 232, 332 may be used in a manner that is similar or identical to the entry section 132 (FIG. 1) to open the respective zipper assemblies. For each of the packagings 200 and 300, the peel seal is located outside of the interior cavity.

With respect to FIG. 5, the zipper assembly 210 has first and second zipper portions 212, 214. The peel seal 260 is disposed between the entry section 232 of the second sidewall 204 and an upper zipper extension of the first zipper portion 212. The second sidewall 204 may be shaped and the peel seal 260 may be positioned such that the zipper portion 212 is not exposed to the surrounding environment. As discussed above, the peel seal 260 may be configured to reduce the surface area that is exposed to the surrounding environment and to increase the distance that unwanted gases and liquid must travel through the peel seal 260 to reach the interior.

With respect to FIG. 6, the packaging 300 also includes a zipper assembly 310 having first and second zipper portions 312, 314. The peel seal 360 is disposed between an entry section 332 and the second sidewall 304. The entry section 332 is sized and shaped such that a portion 333 of the entry section 332 overlaps a portion 315 of the second sidewall 304. The portion 315 may be referred to as the overlapped portion. As before, the second sidewall 304 may be shaped and the peel seal 360 may be positioned such that the zipper portion 312 is not exposed to the surrounding environment. The entry section 332 has a length that extends over the overlapped portion 315 of the second sidewall 304 such that the overlapped portion 315 of the second sidewall 304 is located between the entry section 332 and an upper zipper extension 342 of the first zipper portion 312. The peel seal 360 couples an interior surface of the entry section 332 with an exterior surface of the overlapped portion 315 of the second sidewall 304. Thus, the peel seal 360 extends between and directly engages the entry section 332 and the second sidewall 304. As described above, the peel seal 360 may be configured to reduce the surface area that is exposed to the surrounding environment and to increase the distance that unwanted gases and liquid must travel through the peel seal 360 to reach the interior.

One or more embodiments may include more than one peel seal. For example, a first peel seal, such as the peel seal 160 shown in FIG. 1, may be disposed between opposing surfaces of the zipper assembly and couple the opposing surfaces of the zipper assembly with each other. A second peel seal, such as the peel seal 260 shown in FIG. 5, may be disposed between and couple the entry section of the first sidewall with the zipper assembly. A third peel seal, such as the peel seal 360 shown in FIG. 6, may be disposed between and couple the entry section of the first sidewall with another portion of the first sidewall. Alternatively, one or more embodiments may include the first and second peel seals, but not the third peel seal. Alternatively, one or more embodiments may include the first and third peel seals, but not the second peel seal. Alternatively, one or more embodiments may include the second and third peel seals, but not the first peel seal.

Optionally, a peel seal may be disposed between the entry section and both the zipper assembly and another portion of the first sidewall. Such embodiments may be similar to a combination of the embodiments shown in FIGS. 5 and 6. In particular, the peel seal may extend between and couple the entry section of the first sidewall to the zipper assembly and also another portion of the first sidewall. The peel seal may be sized and shaped such that one side of the peel seal engages both the zipper assembly and the other portion of the first sidewall. The other side of the peel seal may engage only the entry section. For example, the peel seal may be sized and shaped to couple to the portion of the first sidewall (e.g., portion 315) and also clear an edge of the portion of the first sidewall and couple to the zipper assembly (e.g., a portion of the exterior surface of the upper zipper extension 342). Accordingly, a single peel seal may directly engage the portion of the first sidewall and also the zipper assembly. Optionally, this single overlapping peel seal may be combined with one or more other peel seals described herein. For example, an additional peel seal may couple the opposing surfaces of the zipper assembly.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are example embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A child-deterrent packaging comprising:

an enclosure having opposing first and second sidewalls coupled with each other, the first sidewall having an entry section extending away from the first and second sidewalls;

a zipper assembly coupled with the first and second sidewalls of the enclosure, the zipper assembly also disposed between the second sidewall and the entry section of the first sidewall, the zipper assembly including first and second zipper portions that mate with each other to enclose product within the enclosure and that release from each other to provide access to the product within the enclosure, wherein a transverse force is required to release the first and second zipper portions, and wherein the force is greater when the force is applied to the enclosure above and between the first and second zipper portions and the entry section than when the force is applied to the enclosure on the side of the zipper portions opposite the entry section and below the zipper portions; and a peel seal providing a barrier to ingress of one or more of oxygen or moisture into the enclosure through the zipper assembly, the peel seal, disposed between and coupling the first and second zipper portions with each other, disposed between and coupling the entry section of the first sidewall with the first zipper portion of the zipper assembly, or disposed between and coupling the entry section of the first sidewall with another portion of the first sidewall such that the peel seal provides greater resistance to rupture when a transverse force is applied to the enclosure above and between the first and second zipper portions and the entry section than when the force is applied to the enclosure on the side of the zipper portions opposite the entry section and below the zipper portions.

2. The packaging of claim 1, wherein each of the first zipper portion and the second zipper portion include zipper extensions extending within the enclosure, the peel seal disposed between and coupled with surfaces of the zipper extensions of the first zipper portion and the second zipper portion that face each other.

3. The packaging of claim 1, wherein the first zipper portion is affixed to the first sidewall and the second zipper portion is affixed to the second sidewall, the peel seal coupling an interior surface of the entry section with an exterior surface of the first zipper portion that faces away from the second zipper portion.

4. The packaging of claim 1, wherein the entry section has a length that extends over an overlapped portion of the first sidewall such that the overlapped portion of the first sidewall is located between the entry section and the first zipper portion.

5. The packaging of claim 4, wherein the peel seal couples an interior surface of the entry section with an exterior surface of the overlapped portion of the first sidewall.

6. The packaging of claim 1, wherein the peel seal is formed from a resealable adhesive applied to one or more of the entry section, the zipper assembly, or the first sidewall at a location other than the entry section.

7. The packaging of claim 1, wherein the peel seal is a single-use seal that is ruptured after separating the entry section from one or more of the first zipper portion or the first sidewall.

8. The packaging of claim 1, wherein the peel seal is a multiple-use seal that can be opened and re-sealed two or more times after separating the entry section from one or more of the first zipper portion or the first sidewall.

9. The packaging of claim 1, wherein the entry section is formed by a slit in the first sidewall with the first zipper portion affixed to the first sidewall in locations on opposite sides of the slit.

10. A resealable assembly for joining opposing first and second sidewalls of an enclosure, the first sidewall having a slit and forming an entry section, the resealable assembly comprising:

a first zipper portion configured to be affixed to the first sidewall;

a second zipper portion configured to be affixed to the second sidewall, the first and second zipper portions shaped to mate and unmate with each other to enclose and provide access to, respectively, an interior cavity of the enclosure, wherein a force is required to release the first and second zipper portions, and wherein the force is greater when the force is applied to the enclosure above and between the first and second zipper portions and the entry section than when the force is applied to the enclosure on the side of the zipper portions opposite the entry section and below the zipper portions; and a peel seal one or more of: coupling the entry section of the first sidewall with the first zipper portion, coupling the entry section of the first sidewall with another portion of the first sidewall, or coupling the first zipper portion with the second zipper portion such that the peel seal provides greater resistance to rupture when a transverse force is applied to the enclosure above and between the first and second zipper portions and the entry section than when the force is applied to the enclosure on the side of the zipper portions opposite the entry section and below the zipper portions.

11. The resealable assembly of claim 10, wherein the peel seal forms a barrier to ingress of one or more of oxygen or moisture into the interior of the enclosure through the zipper assembly.

12. The resealable assembly of claim 10, wherein the peel seal couples an interior surface of the entry section of the first sidewall with an exterior surface of the first zipper portion.

13. The resealable assembly of claim 10, wherein the entry section of the first sidewall has a length that extends over an overlapped portion of the first sidewall that is affixed to the first zipper portion such that the overlapped portion of the first sidewall is located between the entry section of the first sidewall and the first zipper portion.

14. The resealable assembly of claim 13, wherein the peel seal couples an interior surface of the entry section of the first sidewall with an exterior surface of the overlapped portion of the first sidewall.

15. The resealable assembly of claim 10, wherein the peel seal is formed from a resealable adhesive applied to one or more of the entry section of the first sidewall, the first zipper portion, or a location on the first sidewall other than the entry section.

16. The resealable assembly of claim 10, wherein the peel seal is a single-use seal that is broken after separating the entry section of the first sidewall from one or more of the first zipper portion or the first sidewall.

17. The resealable assembly of claim 10, wherein the peel seal is a multiple-use seal that can be opened and re-sealed two or more times after separating the entry section of the first sidewall from one or more of the first zipper portion or the first sidewall.

18. An enclosure comprising:

first and second sidewalls coupled with each other, the first sidewall having an entry section extending away from the first sidewall to an outer edge;

a zipper assembly coupled with the first and second sidewalls and disposed between the second sidewall and the entry section of the first sidewall, the zipper assembly configured to enclose an interior cavity between the first and second sidewalls and open to provide access to the interior volume wherein a force is required to release the first and second zipper portions, and wherein the force is greater when the force is applied to the enclosure between the first and second zipper portions and the entry section than when the force is applied to the enclosure above and on the side of the zipper portions opposite the entry section and below the zipper portions; and a peel seal one or more of: disposed between and coupling the entry section of the first sidewall with the zipper assembly, disposed between and coupling the entry section of the first sidewall with another portion of the first sidewall, or disposed between and coupling opposing surfaces of the zipper assembly with each other such that the peel seal provides greater resistance to rupture when a transverse force is applied to the enclosure between the first and second zipper portions and the entry section than when the force is applied to the enclosure above and on the side of the zipper portions opposite the entry section and below the zipper portions.

19. The enclosure of claim 18, wherein the peel seal provides a barrier to ingress of one or more of oxygen or moisture into the interior volume through the zipper assembly.

20. The enclosure of claim 18, wherein the peel seal couples an interior side of the entry section of the first sidewall with an exterior side of the zipper assembly.

21. The enclosure of claim 18, wherein the peel seal couples an interior side of the entry section of the first sidewall with an exterior side of the first sidewall.

* * * * *